US009329570B1

(12) United States Patent
Mizutani

(10) Patent No.: US 9,329,570 B1
(45) Date of Patent: May 3, 2016

(54) IMAGE FORMING APPARATUS, AND TONER COLLECTING CASE FOR USE IN IMAGE FORMING APPARATUS

(71) Applicant: KYOCERA Document Solutions Inc., Osaka-shi, Osaka (JP)

(72) Inventor: Naoki Mizutani, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/922,866

(22) Filed: Oct. 26, 2015

(30) Foreign Application Priority Data

Oct. 30, 2014 (JP) ..... 2014-221921

(51) Int. Cl.
*G03G 21/00* (2006.01)
*G03G 21/20* (2006.01)

(52) U.S. Cl.
CPC ..... *G03G 21/206* (2013.01); *G03G 21/20* (2013.01)

(58) Field of Classification Search
CPC ..... G03G 21/20; G03G 21/206
USPC ..... 399/92, 93, 94, 98
See application file for complete search history.

(56) References Cited

U.S. PATENT DOCUMENTS

2006/0257161 A1* 11/2006 Adachi ..... G03G 21/206 399/92
2011/0103821 A1* 5/2011 Akiyama ..... G03G 21/206 399/93
2013/0243472 A1* 9/2013 Yamashita ..... G03G 21/206 399/98

FOREIGN PATENT DOCUMENTS

JP 2008262082 A 10/2008

* cited by examiner

*Primary Examiner* — Hoang Ngo
(74) *Attorney, Agent, or Firm* — Alleman Hall McCoy Russell & Tuttle LLP

(57) ABSTRACT

In an image forming apparatus, a dust collecting unit is disposed in the front side of image forming units. The dust collecting unit includes a dust collecting box and a fan. The dust collecting box is communicated with developer cases. The fan sucks air in the dust collecting box and discharges the air. The fan sucks air that has passed through a filter in the dust collecting box and discharges the air to an exhaust duct. The exhaust duct is disposed between a toner container and a fixing device and forms an air passage that extends in a front-rear direction to reach an opening portion provided in the rear side. The air is discharged to an outside of the apparatus from the opening portion.

8 Claims, 11 Drawing Sheets

IMAGE FORMING APPARATUS, AND TONER COLLECTING CASE FOR USE IN IMAGE FORMING APPARATUS

INCORPORATION BY REFERENCE

This application is based upon and claims the benefit of priority from the corresponding Japanese Patent Application No. 2014-221921 filed on Oct. 30, 2014, the entire contents of which are incorporated herein by reference.

BACKGROUND

The present disclosure relates to an image forming apparatus including a mechanism for removing flying toner by sucking air from a toner storing portion of a developing portion, and relates to a toner collecting case for use in the image forming apparatus.

In an image forming apparatus, there may be a case where a peripheral temperature of a toner storing portion rises under the influence of peripheral air heated by a heating device. Toner is made of resin. As a result, when the peripheral temperature of the toner storing portion rises and the temperature of the toner rises, the fluidity of the toner is reduced. In addition, for the toner to be adhered to a photoconductor drum, the toner needs to be electrically charged. However, the temperature rise is a factor of reducing the amount of charged toner. When the fluidity of the toner or the amount of charged toner is reduced, a sufficient amount of toner may not adhere to the photoconductor drum, resulting in an image defect such as a reduced density. Thus, various technologies have been proposed to restrict the temperature rise of the toner in the toner storing portion. For example, there is known a conventional technology in which a cooling fan is used to send a cooling air to a vent passage for cooling the developing device.

SUMMARY

An image forming apparatus according to an aspect of the present disclosure includes a developing portion, a transfer portion, a fixing portion, a first duct portion, a fan, a filter portion, a second duct portion, and an opening portion. The developing portion includes a toner storing portion storing toner, and performs a developing process by using the toner of the toner storing portion. The transfer portion transfers a toner image formed in the developing process, onto a sheet member. The fixing portion fixes, by heating, the toner image transferred onto the sheet member, to the sheet member. The first duct portion is communicated with the toner storing portion in such a way as to form a flow-in passage through which air having flowed in from an inside of the toner storing portion passes. The fan sucks the air from the flow-in passage of the first duct portion and discharges the air to an outside of the first duct portion. The filter portion is disposed in the first duct portion and collects flying toner included in the air that passes through the flow-in passage. The second duct portion extends from an air discharge port of the fan along the fixing portion in a vicinity of the fixing portion in such a way as to form a discharge passage through which the air discharged from the air discharge port passes. The opening portion is formed at an end of the second duct portion in an extension direction thereof in such a way as to allow an inside of the second duct portion to be communicated with an outside of an apparatus main body.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
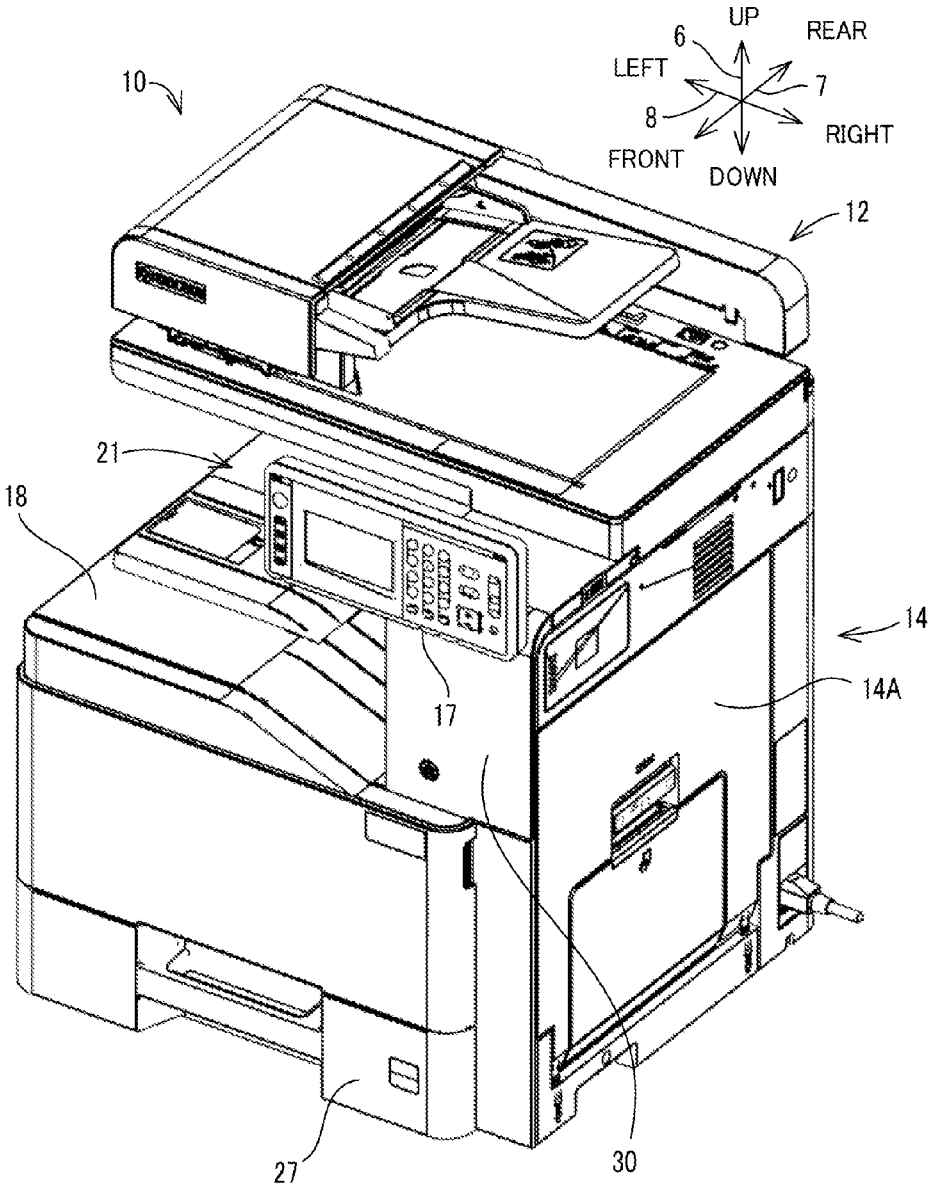
FIG. 1 is a perspective view showing an image forming apparatus according to an embodiment of the present disclosure.

The following describes an embodiment of the present disclosure with reference to the attached drawings. It should be noted that the embodiment described in the following is an example of a specific embodiment of the present disclosure and should not limit the technical scope of the present disclosure.

[Image Forming Apparatus 10]

For the sake of explanation in the following description, an up-down direction 6 is defined based on the state where an image forming apparatus 10 is installed to be usable (the state shown in FIG. 1). In addition, a front-rear direction 7 is defined on the supposition that the side on which an operation display portion 17 is provided in the above-mentioned installment state is the front side. Furthermore, a left-right direction 8 is defined based on the image forming apparatus 10 in the installment state viewed from the front side.

As shown in FIG. 1, the image forming apparatus 10 of a so-called "in-body discharge type" includes an image reading portion 12 and an image forming portion 14. The image reading portion 12 performs a process of reading an image from a document sheet, and is provided in the upper part of the image forming apparatus 10. The image forming portion 14 performs a process of forming an image based on the electrophotography, and is provided in the lower part of the image forming apparatus 10. A sheet feed cassette 27 is provided below the image forming portion 14. In addition, a paper sheet discharge portion 30 is provided in the right side of the image forming portion 14.

Above the image forming portion 14, there is provided a sheet discharge space 21. The paper sheet discharge portion 30 is formed in such a way as to couple the image forming portion 14 and the image reading portion 12 vertically with the sheet discharge space 21 formed therebetween. As shown in FIG. 1, the front side and the left side of the sheet discharge space 21 are opened. In addition, the rear side of the sheet discharge space 21 is not opened, but is closed by a rear cover 15 (see FIG. 2). The paper sheet discharge portion 30 is provided on the right side of the sheet discharge space 21. In this way, the right side of the sheet discharge space 21 is closed. A sheet discharge tray 18 (an example of the discharged sheet holding portion of the present disclosure) is provided in the sheet discharge space 21. Sheet members discharged from the paper sheet discharge portion 30 are stacked on the sheet discharge tray 18.

The image forming portion 14 includes a housing 14A as an apparatus main body. The housing 14A has an approximately rectangular parallelepiped shape. The components constituting the image forming portion 14 are arranged in the housing 14A.

Figure 2:
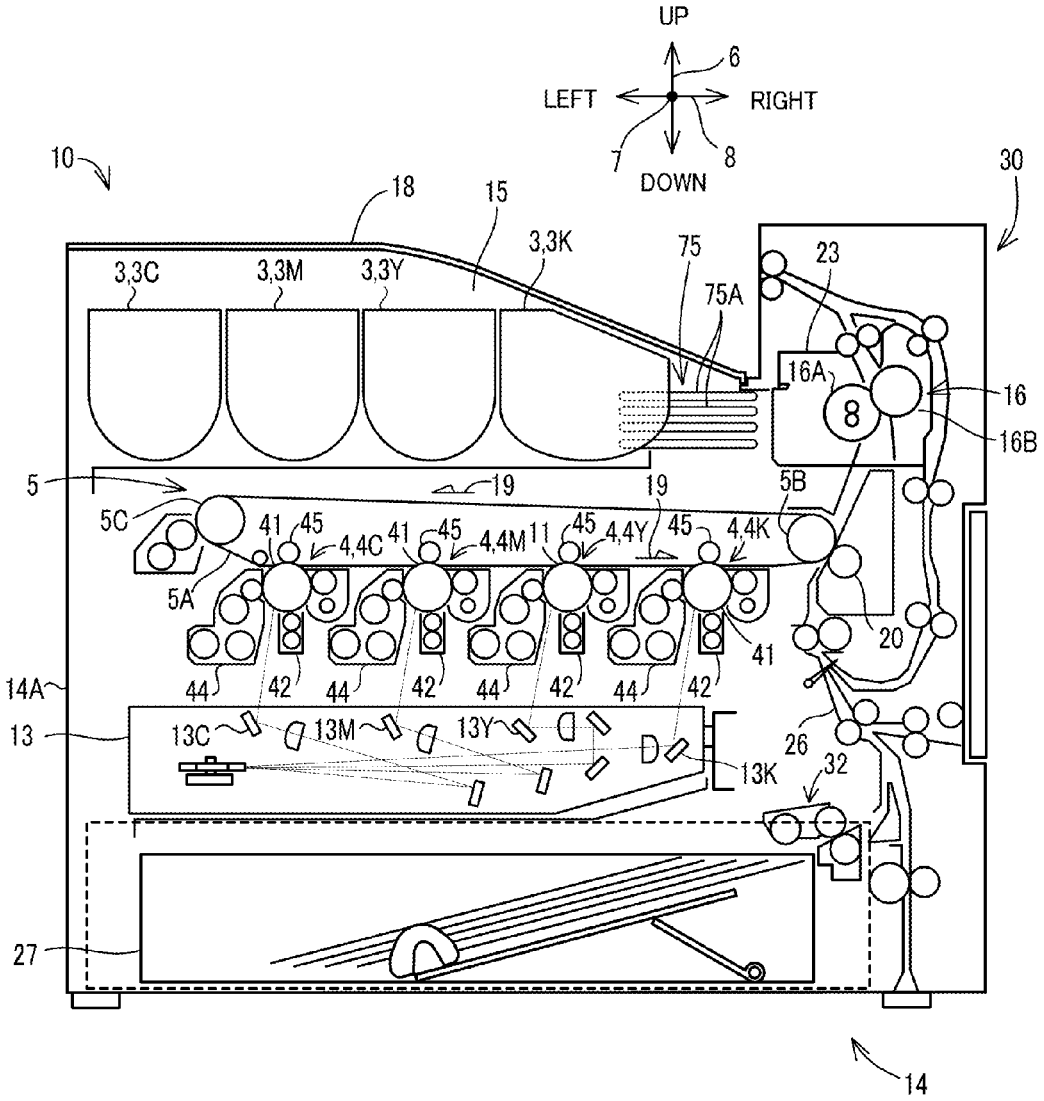
FIG. 2 is a diagram showing an internal configuration of the image forming apparatus of FIG. 1.

The image forming portion 14 forms a color image on a sheet member based on a so-called tandem method. As shown in FIG. 2, the image forming portion 14 includes a plurality of image forming units 4, an intermediate transfer unit 5, a laser scanning unit 13, a secondary transfer roller 20 (an example of the transfer portion of the present disclosure), a fixing device 16 (an example of the fixing portion of the present disclosure), the sheet discharge tray 18, the sheet feed cassette 27, a sheet feed unit 32, an operation display portion 17 (see FIG. 1), a conveyance path 26, a plurality of toner containers 3, a dust collecting unit 80, and a control portion (not shown). The image forming portion 14 forms, based on input image data, a monochrome image or a color image on a sheet member such as a print sheet by using a print material such as toner. It is noted that the image forming apparatus 10 is not limited to a tandem color image forming apparatus, but may be an apparatus that includes a single image forming unit 4 and can form a single-color image (for example, a monochrome image).

The operation display portion 17 is, for example, a touch panel which displays various types of information based on control signals from the control portion and inputs various types of information to the control portion in response to user operations.

The sheet feed unit 32 picks up, one by one, sheet members stacked in the sheet feed cassette 27, and feeds the sheet member toward the conveyance path 26.

The image forming units 4 (4C, 4M, 4Y, and 4K) are provided below the intermediate transfer unit 5. Each of the image forming units 4 includes a photoconductor drum 41, a charging device 42, a developing device 44 (an example of the developing portion of the present disclosure), and a primary transfer roller 45, and forms an image based on the electrophotography. The image forming units 4 are arranged in alignment in the running direction of an intermediate transfer belt 5A (the direction indicated by the arrow 19). The image forming unit 4C forms a toner image on the photoconductor drum 41 by using cyan toner. The image forming unit 4M forms a toner image on the photoconductor drum 41 by using magenta toner. The image forming unit 4Y forms a toner image on the photoconductor drum 41 by using yellow toner. The image forming unit 4K forms a toner image on the photoconductor drum 41 by using black toner. The developing devices 44 develop the toner images on the photoconductor drums 41 respectively.

In the housing 14A, a plurality of photoconductor drums 41 are disposed in correspondence with the plurality of image forming units 4. The photoconductor drums 41 are rotatably supported by the housing 14A and the like. Specifically, cases 41A are provided in the housing 14A to store the photoconductor drums 41 respectively (see FIG. 4). Each of the photoconductor drums 41 is rotatably supported by opposite side walls of the case 41A in the longitudinal direction. Each of the cases 41A includes a transmission portion 41B (see FIG. 4) for transmitting a power to the rotation shaft of the photoconductor drum 41. When a driving force is input to the transmission portion 41B, the photoconductor drum 41 rotates in a predetermined direction. The photoconductor drum 41 carries, on its surface, a toner image that is formed in a developing process performed by the developing device 44.

Figure 3:
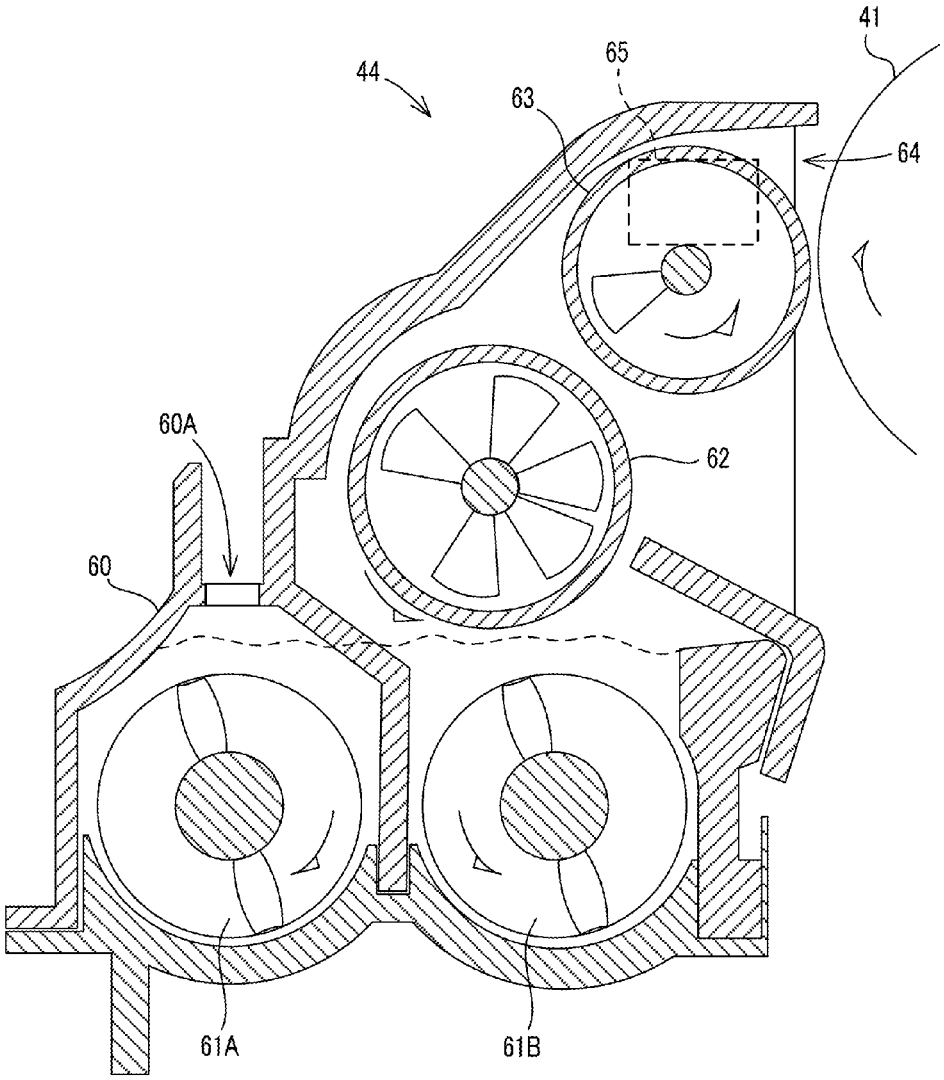
FIG. 3 is a diagram showing a configuration of a developing device included in the image forming apparatus of FIG. 1.

As shown in FIG. 3, each of the developing devices 44 includes a developer case 60 (an example of the toner storing portion of the present disclosure) for storing two-component developer (hereinafter, merely referred to as developer). The developing device 44 forms a toner image on the surface of the photoconductor drum 41 by performing the developing process by using the toner of the developer case 60. The developer cases 60 have an elongated shape and are disposed extending in the front-rear direction 7 in the housing 14A. Each of the developer cases 60 stores the developer in which the toner is included, and also plays a role of a housing of the developing device 44. In the developer case 60, the developer is stored, at maximum, to the height indicated by the dotted line in FIG. 3. Two stirring screws 61A and 61B are rotatably provided at the bottom of the developer case 60. With the rotation of the stirring screws 61A and 61B, the developer is stirred and the toner is electrically charged. Each of the developer cases 60 includes a toner replenishing port 60A, and the toner is replenished to the developer case 60 via the toner replenishing port 60A from the toner container 3 that is described below.

A magnetic roller 62 and a developing roller 63 are rotatably provided in the developer case 60. The magnetic roller 62 holds the developer in the developer case 60 on its surface by the magnetic force. The developing roller 63 is disposed to face the magnetic roller 62. In addition, in an opening 64 side of the developer case 60 (the right side in FIG. 3), the developing roller 63 is disposed to face the outer circumferential surface of the photoconductor drum 41. An electric field is formed between the magnetic roller 62 and the developing roller 63, and due to the electric field, a so-called magnetic brush is formed on the surface of the magnetic roller 62. When the surface of the developing roller 63 contacts the magnetic brush, the toner moves from the magnetic roller 62 to the developing roller 63. In addition, an electric field is formed between the photoconductor drum 41 and the developing roller 63, and due to the electric field, the toner held by the developing roller 63 flies to the photoconductor drum 41 and adheres to the electrostatic latent image. The electrostatic latent image on the photoconductor drum 41 is developed by the toner, and a toner image is formed on the photoconductor drum 41.

Figure 4:
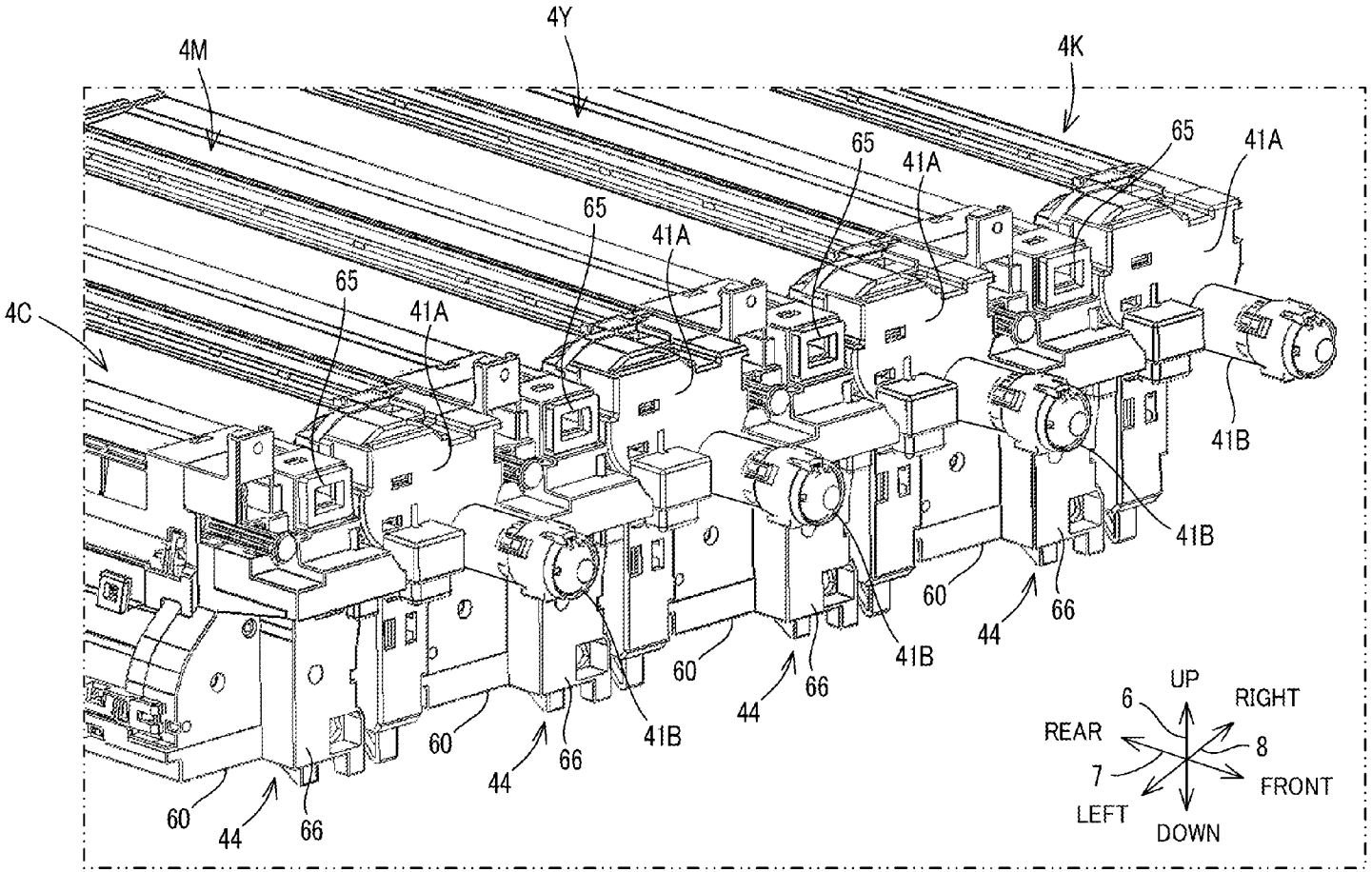
FIG. 4 is a perspective view showing a configuration of the front side of image forming units included in the image forming apparatus of FIG. 1.

A vent hole portion 65 is provided at an end of each developer case 60 in the longitudinal direction. The vent hole portions 65 are communicated with a dust collecting box 81 (an example of the first duct and the toner collecting case of the present disclosure) that is described below. As shown in FIG. 4, the vent hole portions 65 are respectively provided in side walls 66 of the developer cases 60 in the front side. Each of the vent hole portions 65 is disposed at a position of an enclosure indicated by the dotted line in FIG. 3. Specifically, the vent hole portion 65 is positioned close to an opening 64, slightly above the rotation shaft of the developing roller 63. The vent hole portions 65 are passages through which the air and flying toner in the developer cases 60 flow into the dust collecting box 81. Since the vent hole portions 65 are formed at such a position, when the air flows out of the developer cases 60 from the vent hole portions 65, the airflow caused by it does not stir up the toner of the developer at the bottom of the developer cases 60, but allows only the air including flying toner to flow out of the developer case 60.

As shown in FIG. 2, the intermediate transfer unit 5 includes an intermediate transfer belt 5A, a driving roller 5B, and a driven roller 5C. The intermediate transfer belt 5A is disposed above the photoconductor drums 41. The intermediate transfer belt 5A is supported by the driving roller 5B and the driven roller 5C so as to be able to run around them. The intermediate transfer belt 5A is suspended between and supported by the driving roller 5B and the driven roller 5C. As such, the intermediate transfer belt 5A extends approximately in the horizontal direction.

The intermediate transfer belt 5A is an endless belt member on which toner images of respective colors are transferred from the photoconductor drums 41 of the image forming units 4. Supported by the driving roller 5B and the driven roller 5C, the intermediate transfer belt 5A can move (run) in the direction indicated by the arrow 19 in the state where its surface is in contact with the surfaces of the photoconductor drums 41. When the intermediate transfer belt 5A passes through between the photoconductor drums 41 and the primary transfer rollers 45, the toner images are transferred in sequence from the photoconductor drums 41 onto a surface of the intermediate transfer belt 5A so as to be overlaid with each other.

The image forming units 4 form a color image based on the tandem method. The plurality of image forming units 4 are disposed in alignment along the running direction (horizontal direction) of the intermediate transfer belt 5A. In order from left to right of the intermediate transfer belt 5A, the image forming units 4C, 4M, 4Y, and 4K are disposed, wherein the image forming unit 4C forms a cyan image, the image forming unit 4M forms a magenta image, the image forming unit 4Y forms a yellow image, and the image forming unit 4K forms a black image. In this way, there are provided a plurality of photoconductor drums 41 and a plurality of developing devices 44.

The laser scanning unit 13 includes a laser light source that emits a laser beam for the respective colors, a polygon mirror for scanning the laser beam, and mirrors 13C, 13M, 13Y, and 13K for reflecting the scanned laser beam. The laser scanning unit 13 forms electrostatic latent images respectively on the photoconductor drums 41 by irradiating the laser beam to the photoconductor drums 41 of the image forming units 4 based on the input image data of respective colors.

The secondary transfer roller 20 is disposed to face the driving roller 5B such that the conveyance path 26 that extends in the vertical direction is nipped by the secondary transfer roller 20 and the driving roller 5B. A transfer potential is applied to the secondary transfer roller 20, and thereby the toner image on the intermediate transfer belt 5A is transferred onto a sheet member. The sheet member with the toner image transferred thereon is conveyed to the fixing device 16.

The fixing device 16 is provided further above the secondary transfer roller 20. The fixing device 16 fixes the toner image that has been transferred onto the sheet member, to the sheet member by heating the toner image. The fixing device 16 is disposed at approximately the same height as the toner containers 3 when viewed horizontally, wherein the toner containers 3 are described below. As shown in FIG. 2, the fixing device 16 is disposed near the right-side end of the housing 14A. The fixing device 16 includes a case 23, a heating roller 16A, and a pressure roller 16B. The heating roller 16A and the pressure roller 16B are disposed inside the case 23. The case 23 blocks a space inside thereof from an exhaust duct 71 that is described below, so as to prevent an inflow/outflow of air from occurring between the exhaust duct 71 and an inside of the case 23. The heating roller 16A is heated by a heating device to a predetermined temperature at which the toner can be fixed. The pressure roller 16B is disposed to face the heating roller 16A. The heating roller 16A is disposed on the left side and the pressure roller 16B is disposed on the right side in such a manner that the conveyance path 26 extending in the vertical direction is nipped by the heating roller 16A and the pressure roller 16B. The pressure roller 16B is biased by an elastic member (not shown) to be pressed against the heating roller 16A. In the fixing device 16, the sheet member is conveyed while being nipped by the heating roller 16A and the pressure roller 16B. During this conveyance, heat is transmitted to the toner image that has been transferred onto the sheet member so that the toner image is heated. This allows the toner image to be fused and fixed to the sheet member. After this, the sheet member is discharged onto the sheet discharge tray 18.

A plurality of toner containers 3 are disposed above the intermediate transfer unit 5. The toner containers 3 are configured to store toner and are supported in such a manner that they can be attached to and detached from the housing 14A. In the state where the toner containers 3 are attached to the housing 14A, toner is supplied from the toner containers 3 to the developer cases 60 via a toner conveyance path (not shown). The sheet discharge tray 18 is disposed above the toner containers 3 to cover the toner containers 3.

The toner containers 3 are disposed in alignment along the running direction of the intermediate transfer belt 5A (horizontal direction). In order from left to right of the intermediate transfer belt 5A, a toner container 3C for cyan toner, a toner container 3M for magenta toner, a toner container 3Y for yellow toner, and a toner container 3K for black toner are disposed in alignment. That is, a plurality of toner containers 3 are disposed in alignment along the left-right direction 8 in which the intermediate transfer belt 5A extends. Among the plurality of toner containers 3, the toner container 3K is disposed at the right end. The toner container 3K stores black toner that is highly frequently used, and is larger in capacity and size than the other toner containers 3.

As shown in FIG. 2, in the present embodiment, the toner container 3K is disposed adjacent to the fixing device 16. Specifically, the toner container 3K is disposed on the left side of the fixing device 16 with a predetermined interval therebetween. Among the plurality of toner containers 3, the toner container 3K is closest to the fixing device 16. The space between the toner container 3K and the fixing device 16 constitutes the exhaust duct 71 (an example of the second duct portion of the present disclosure) which is an exhaust passage through which the exhaust discharged by a fan 82 (an example of the fan of the present disclosure) passes, wherein the fan 82 is described below. That is, the exhaust duct 71 is disposed between the toner container 3K and the fixing device 16. The exhaust duct 71 extends in the front-rear direction 7 in the housing 14A. The exhaust duct 71 extends in the vicinity of the fixing device 16 in the front-rear direction 7 along the case 23 on the left side of the fixing device 16. In the present embodiment, the left side of the exhaust duct 71 is defined by the side wall of the toner container 3K, and the right side thereof is defined by the case 23 of the fixing device 16. In addition, the lower side of the exhaust duct 71 is defined by the intermediate transfer belt 5A, and the upper side thereof is defined by the sheet discharge tray 18. That is, the exhaust duct 71 is defined by the toner container 3K, the case 23, the sheet discharge tray 18, and the intermediate transfer belt 5A.

The fan 82 is disposed in the front side of the exhaust duct 71. In addition, an opening portion 75 is formed in the rear side of the exhaust duct 71 (at an end in the extension direction). The opening portion 75 includes a plurality of through holes 75A formed in the rear cover 15 of the housing 14A. The through holes 75A allow the inside of the exhaust duct 71 to communicate with the outside of the housing 14A. This allows the air in the exhaust duct 71 to be discharged to outside via the opening portion 75.

Meanwhile, in a configuration where a heating device is used to fix a toner image to a sheet member, there may be a case where the peripheral temperature of the developer case 60 rises under the influence of the peripheral air heated by the heating device. The toner is made of resin. As a result, when the peripheral temperature of the developer case 60 rises and the temperature of the toner rises, the fluidity of the toner is reduced. In addition, for the toner to be adhered to the photoconductor drum 41, the toner needs to be electrically charged. However, the temperature rise is a factor of reducing the amount of charged toner. When the fluidity of the toner or the amount of charged toner is reduced, a sufficient amount of toner may not adhere to the photoconductor drum 41, resulting in an image defect such as a reduced density. As a result, in a typical conventional technology, in order to restrict the temperature rise of the toner in the developer case 60, a cooling fan is used to send a cooling air to a vent passage for cooling the developing device 44.

However, the factor of an image defect is not limited to a change in the peripheral temperature of the developer case 60. For example, the presence of flying toner in the developer case 60 can be a factor of an image defect. When the flying toner is present in the developer case 60, the flying toner may adhere to an area (non-image area) other than the electrostatic latent image on the photoconductor drum 41 under an influence of an electric field by a developing bias. When the flying toner adheres to the non-image area, a phenomenon occurs where an area that should be formed as a white area is formed as a half-tone area (so-called toner fogging).

To realize the cooling of the toner and the removal of the flying toner, a plurality of fans may be installed respectively for the purposes. However, to install a plurality of fans separately for the purposes, the attachment spaces need to be ensured. In addition, an air passage needs to be formed in the apparatus for each of those fans. Furthermore, installment of a plurality of fans as such raises a problem of a cost increase due to the increase in the number of parts.

As described in the following, the image forming apparatus 10 of the present disclosure is configured such that both the removal of the flying toner from the developer cases 60 and the restriction of the temperature rise of the toner in the developer case 60 can be easily realized by one fan.

Figure 5:
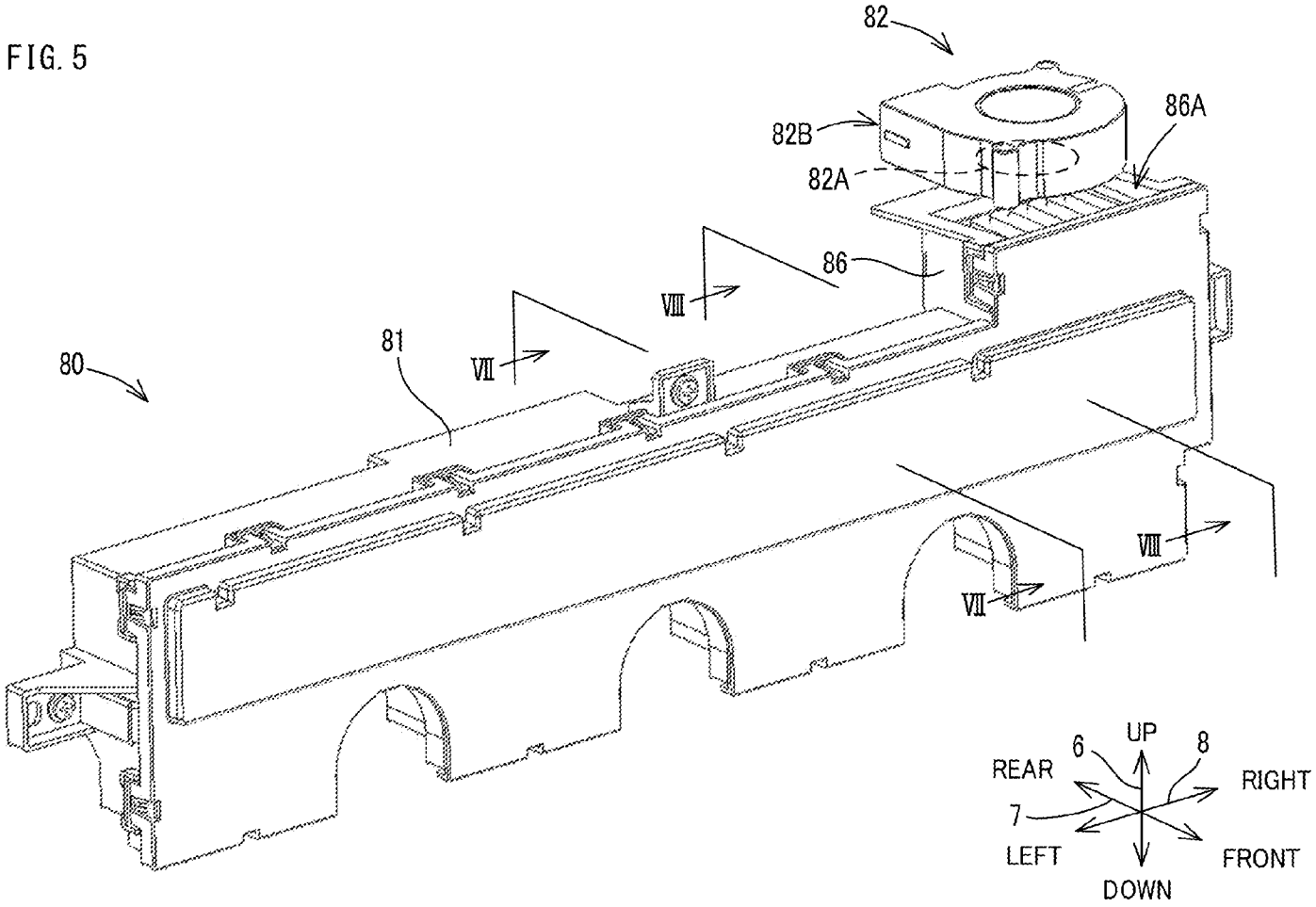
FIG. 5 is a perspective view showing a configuration of a dust collecting unit included in the image forming apparatus of FIG. 1.
Figure 6:
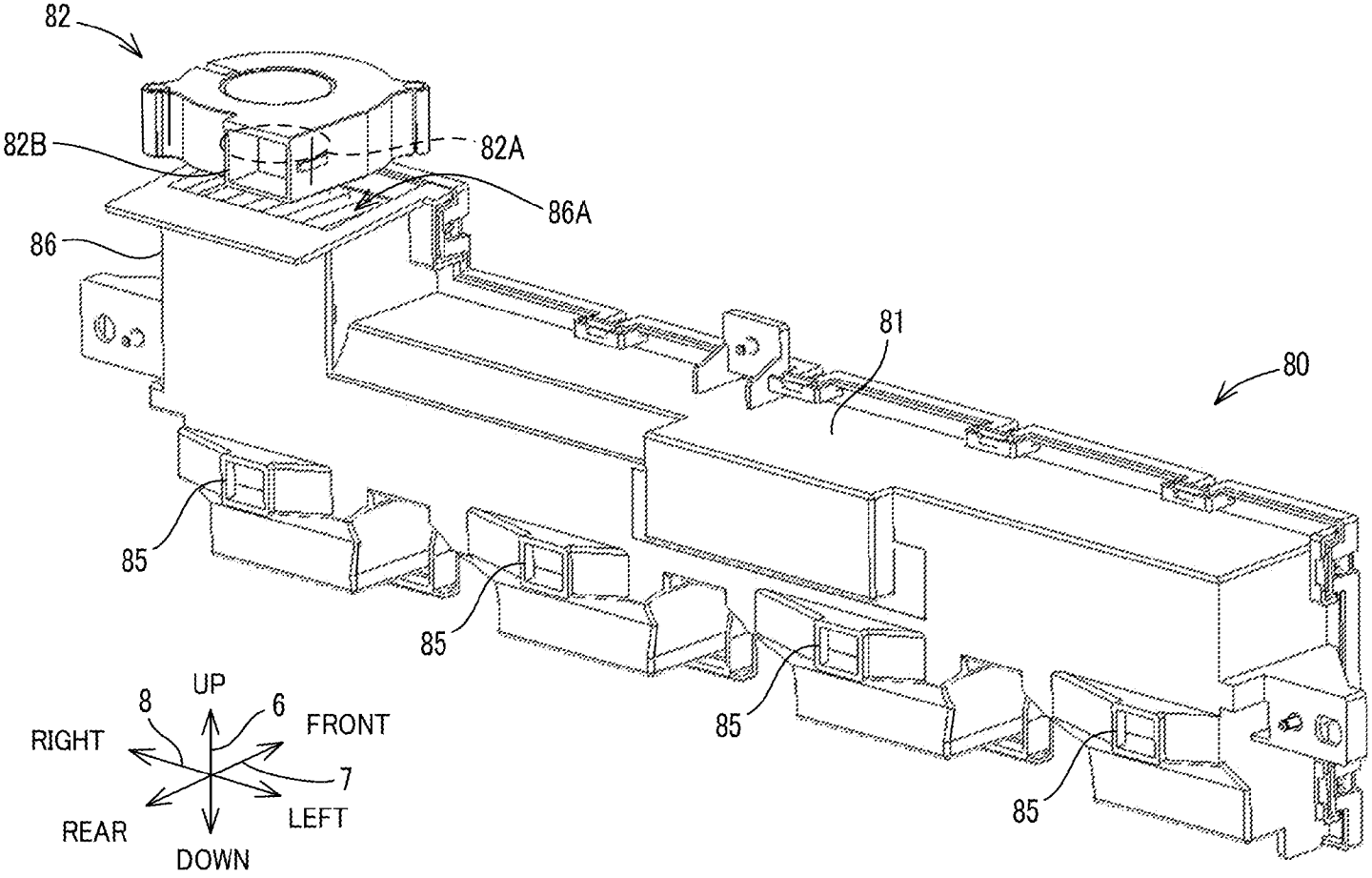
FIG. 6 is a perspective view showing a configuration of the dust collecting unit included in the image forming apparatus of FIG. 1.
Figure 7:
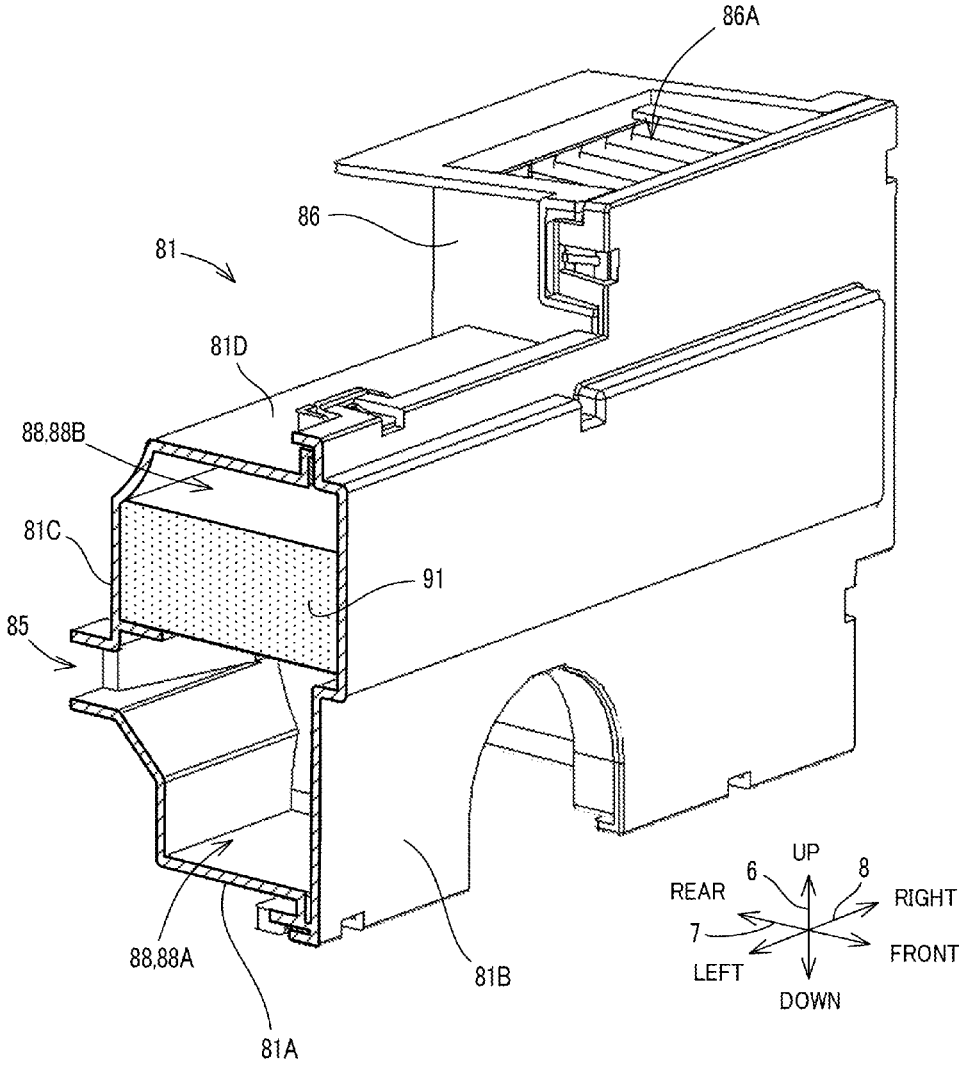
FIG. 7 is a diagram showing an internal configuration of a dust collecting box, and is a cross section taken along a cutting plane VII-VII in FIG. 5.
Figure 8:
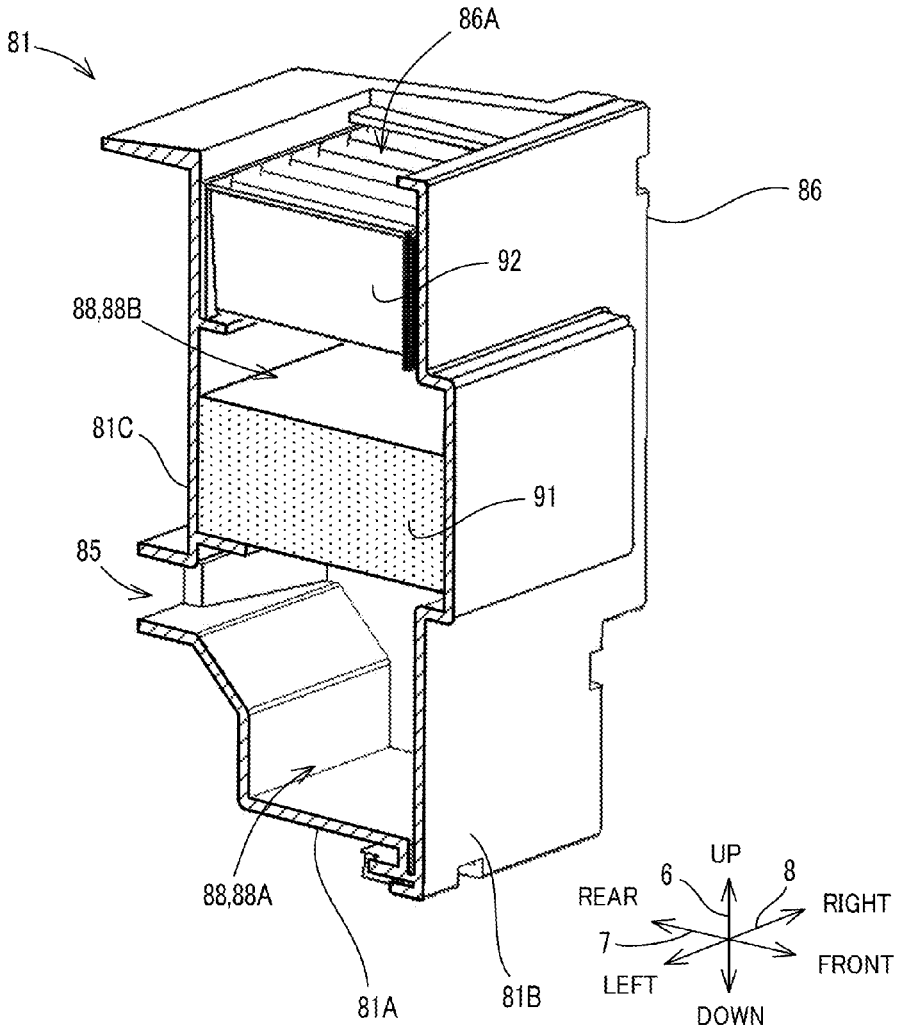
FIG. 8 is a diagram showing an internal configuration of the dust collecting box, and is a cross section taken along a cutting plane VIII-VIII in FIG. 5.
Figure 9:
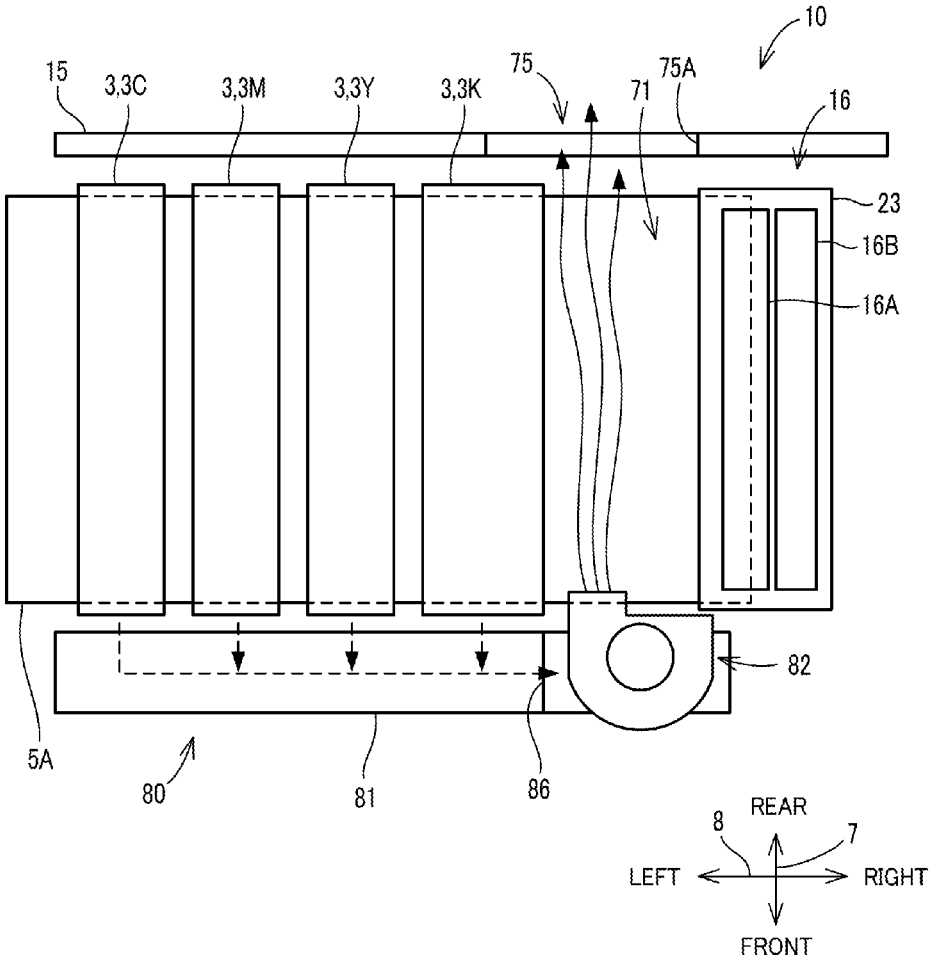
FIG. 9 is a diagram showing the flow of air in the dust collecting unit.

In the following, the configuration of the dust collecting unit 80 is described with reference to FIG. 5 to FIG. 9. Here, FIG. 5 is a perspective view of the dust collecting unit 80 viewed from the front side. FIG. 6 is a perspective view of the dust collecting unit 80 viewed from the rear side. FIG. 7 is a perspective view showing a configuration of a cross section taken along a plane passing through a communication port portion 85 of the dust collecting box 81, cutting the dust collecting box 81 into right-side and left-side parts. FIG. 8 is a perspective view showing a configuration of a cross section taken along a plane passing through an exhaust port portion 86 of the dust collecting box 81, cutting the dust collecting box 81 into right-side and left-side parts. FIG. 9 is a diagram showing the flow of air in the dust collecting unit 80.

The dust collecting unit 80 is disposed in the front side of the plurality of image forming units 4 so as to collect flying toner by sucking air from insides of the developer cases 60 together with the flying toner. As shown in FIG. 5 and FIG. 6, the dust collecting unit 80 includes the dust collecting box 81 and the fan 82.

The dust collecting box 81 is attached to the inside of the housing 14A of the image forming portion 14. The dust collecting box 81 is configured to be attachable to and detachable from the housing 14A so as to be replaceable. The dust collecting box 81 is formed to be long in the left-right direction 8. The dust collecting box 81 is communicated with the developer case 60 so that the air flows in from an inside of the developer case 60. Specifically, as shown in FIG. 6, a plurality of communication port portions 85 are provided in the rear side of the dust collecting box 81. The plurality of communication port portions 85 are respectively connected to the vent hole portions 65 of the developer cases 60 of the plurality of developing devices 44. The dust collecting box 81 is disposed in the front side of the image forming units 4 such that the plurality of communication port portions 85 are connected to the plurality of vent hole portions 65. When the communication port portions 85 and the vent hole portions 65 are positioned and connected to each other, insides of the plurality of developer cases 60 are communicated with an inside of the dust collecting box 81 via the communication port portions 85 and the vent hole portions 65. That is, the communication port portions 85 guide the air from the insides of the developer cases 60 of the developing devices 44 to the inside of the dust collecting box 81. This makes it possible for the air to flow into the inside of the dust collecting box 81 from the insides of the developer cases 60.

An intake passage 88 (an example of the flow-in passage of the present disclosure) is formed in the dust collecting box 81 such that the air having flowed in from the communication port portions 85 passes therethrough. The intake passage 88 is defined by the outer walls of the dust collecting box 81. Specifically, the intake passage 88 is defined by the following: a bottom plate 81A; a side wall 81B in the front side; a side wall 81C in the rear side; and a side wall 81D in the upper side.

As shown in FIG. 7, the dust collecting box 81 includes a primary filter 91 (an example of the filter portion and the first filter of the present disclosure) for collecting the flying toner. The primary filter 91 is provided in such a way as to divide the intake passage 88 in the dust collecting box 81 into two spaces in the up-down direction 6. The lower space under the primary filter 91 is a first passage 88A that is directly communicated with the insides of the developer cases 60. In addition, the upper space on the primary filter 91 is a second passage 88B that is communicated with an air sucking port 82A of the fan 82 that is described below. In this way, the primary filter 91 is disposed between the first passage 88A and the second passage 88B.

The primary filter 91 is configured to remove the flying toner from the air that has flowed into the first passage 88A from the developer cases 60, and is made from a nonwoven fabric, a sponge member or the like. Of course, the primary filter 91 may be made from a material other than the nonwoven fabric or the sponge member as far as it can remove the flying toner. The air that has flowed into the first passage 88A passes through the primary filter 91 and then is sucked up into the second passage 88B by the fan 82 that is described below.

At this time, the flying toner included in the air is collected by the primary filter 91, and the collected flying toner remains in the first passage 88A.

As shown in FIG. 5 and FIG. 6, an exhaust port portion 86 is provided in the right upper part of the dust collecting box 81 so as to discharge the air from the inside of the dust collecting box 81 to outside. The exhaust port portion 86 is communicated with the second passage 88B. The exhaust port portion 86 is in the shape of a rectangular cylinder projecting upward from the second passage 88B. The air that has flowed into the second passage 88B via the primary filter 91 is sucked by the fan 82 that is described below. This allows the air to pass through the second passage 88B, be guided to the exhaust port portion 86, and discharged to outside from the exhaust port portion 86.

The fan 82 is attached to the upper part of the exhaust port portion 86. The fan 82 is an electrically driven fan that sucks the air from the intake passage 88 of the dust collecting box 81 and discharges the air to the outside of the dust collecting box 81. Various types of fans, such as a sirocco fan, a propeller fan, and an axial fan, are applicable as the fan 82. The fan 82 includes the air sucking port 82A for sucking the air. The air sucking port 82A is positioned and connected to an outlet 86A of the exhaust port portion 86. With this configuration, when the fan 82 is driven, the air in the second passage 88B is sucked from the exhaust port portion 86 to the air sucking port 82A. The air sucked from the air sucking port 82A is discharged to outside from an air discharge port 82B of the fan 82.

In the present embodiment, as shown in FIG. 9, the fan 82 is disposed such that the air discharge port 82B faces the exhaust duct 71. In other words, the exhaust duct 71 extends from the air discharge port 82B of the fan 82 to the opening portion 75 of the rear cover 15.

It is noted that the fan 82 may be always on or driven at necessary timing. In the present embodiment, as described below, the fan 82 is driven to achieve both purposes of collecting the flying toner and cooling the toner container 3K. As a result, the fan 82 is desired to be driven from the start to the end of an image formation, or from the start of an image formation to a predetermined time period after the end of the image formation.

As shown in FIG. 8, in the exhaust port portion 86 of the dust collecting box 81, a secondary filter 92 (an example of the filter portion and the second filter of the present disclosure) is provided. The secondary filter 92 is provided to collect flying toner that has not been collected by the primary filter 91, and microparticles that are smaller than toner particles. The secondary filter 92 is disposed in the vicinity of the outlet 86A of the exhaust port portion 86. Specifically, the secondary filter 92 is disposed between the second passage 88B and the outlet 86A of the exhaust port portion 86. In other words, the secondary filter 92 is provided between the second passage 88B and the air sucking port 82A of the fan 82.

As in the primary filter 91, the secondary filter 92 is made from a nonwoven fabric, a sponge member or the like. However, the secondary filter 92 is finer in mesh than the primary filter 91. With this configuration, flying toner and microparticles that have passed through the primary filter 91 can be collected by the secondary filter 92 in a reliable manner. The collected flying toner and the like remain in the second passage 88B.

With the above-described configuration of the image forming apparatus 10 according to the present embodiment, when the fan 82 is driven, air is sucked from the developer cases 60 and flows into the first passage 88A of the dust collecting box 81 from the communication port portions 85. The air that has flowed into the first passage 88A passes through the primary filter 91 and moves to the second passage 88B, and further passes through the secondary filter 92 and is sucked by the fan 82. During such movement of the air, flying toner and microparticles included in the air that has flowed in from the developer cases 60 are collected by the primary filter 91, and toner and microparticles that could not be collected by the primary filter 91 are collected by the secondary filter 92. As a result, the air discharged from the fan 82 is as clean as the air around the image forming apparatus 10. Such a clean air can be used inside the image forming apparatus 10 again for any purposes, without being discharged to the outside of the image forming apparatus 10.

As described above, in the present embodiment, the exhaust air discharged from the fan 82 is sent to the inside of the exhaust duct 71. The air discharged to the inside of the exhaust duct 71 from the fan 82 passes through the exhaust duct 71 to move from the front side of the housing 14A to the rear side, and reaches the opening portion 75 of the rear cover 15. The air is then discharged from the opening portion 75 to the outside of the image forming apparatus 10. When the air passes through the exhaust duct 71 in this way, air warmed by the case 23 is discharged to the outside smoothly. In addition, when the air passes through the exhaust duct 71, the air performs heat exchange with the side wall of the toner container 3K and with the case 23 of the fixing device 16, thereby cooling the toner container 3K and the case 23. As a result, the temperature rise of the toner container 3K is restricted.

In addition, when the air moves from the front side of the exhaust duct 71 toward the opening portion 75 in the rear side of the exhaust duct 71, the peripheral of the air discharge port 82B of the fan 82 becomes the negative pressure state. This allows the surrounding air to flow into the negative pressure area. At this time, the air above the intermediate transfer belt 5A flows into the negative pressure area near the air discharge port 82B, and the intermediate transfer belt 5A is cooled by the air.

As described above, it is possible, by using a single fan 82, to realize the collection of the flying toner in the developer cases 60 and the restriction of the temperature rise of the toner by cooling the toner container 3K. This makes it possible to use the inner space of the housing 14A efficiently, and prevent the size increase of the apparatus. In addition, it becomes possible to cool not only the toner container 3K, but also the intermediate transfer belt 5A. As a result, it is possible to provide efficient cooling effect in the housing 14A.

Furthermore, in the present embodiment, in the side wall 66 of each developer case 60, the vent hole portion 65 is disposed slightly above the rotation shaft of the developing roller 63. As a result, when the fan 82 is driven and the air is sucked from the developer case 60, only the air including flying toner flows out of the developer case 60 into the dust collecting box 81, without stirring up the toner of the developer at the bottom of the developer case 60. With this configuration, clean air is discharged from the fan 82, with the particle content ratio in the air being extremely low.

Figure 10:
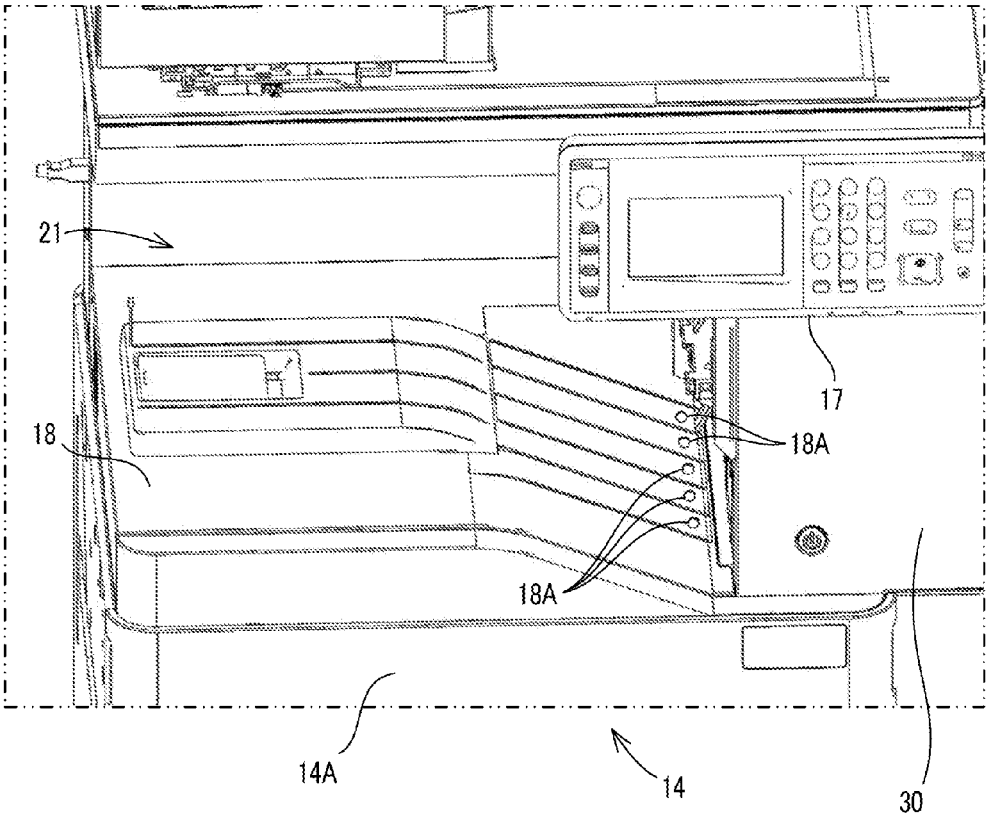
FIG. 10 is a diagram showing a sheet discharge tray according to a modification of an embodiment of the present disclosure.

It is noted that in the present embodiment, a description is given of an example where the sheet discharge tray 18 is disposed above the exhaust duct 71. In this case, as shown in FIG. 10, the sheet discharge tray 18 may have a plurality of through holes 18A (an example of the communication hole of the present disclosure). The plurality of through holes 18A are positioned directly above the exhaust duct 71, forming air passages through which air passes from the exhaust duct 71 to above the sheet discharge tray 18. When the through holes 18A are formed in the sheet discharge tray 18, a sheet member that has passed through the fixing device 16 and has been discharged onto the sheet discharge tray 18 is cooled by the air that comes up through the through holes 18A. The number and size of the through holes 18A are desired to be determined to such a level as not to inhibit the effect of cooling the toner container 3K by the airflow that passes through the exhaust duct 71. With this configuration, the sheet member that has been heated while passing through the fixing device 16 is quickly cooled, and adhering of a sheet member to another sheet member by the toner having just been fused and fixed to the sheet member is prevented. In addition, the temperature rise of the toner container 3K is restricted.

Figure 11:
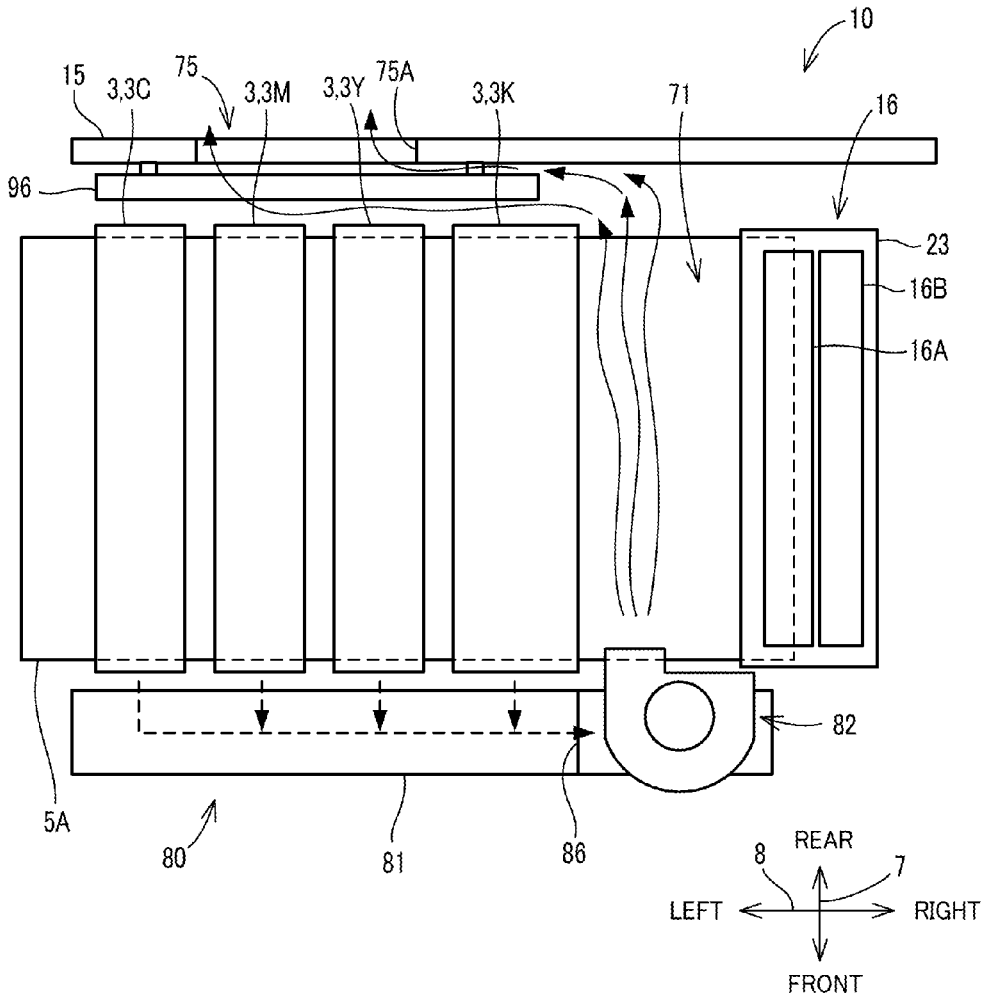
FIG. 11 is a diagram showing the position of an opening portion and the flow of air in the dust collecting unit according to a modification of an embodiment of the present disclosure.

Furthermore, in the above description of the image forming apparatus 10 according to the present embodiment, the attachment position of the control portion that controls the operation of the image forming apparatus 10 is not specified in particular. However, as one example of the control portion, a control board 96 may be disposed on an inner surface of the rear cover 15. In this case, as shown in FIG. 11, the opening portion 75 is desired to be disposed at a position where the control board 96 is attached. In other words, the control board 96 is desired to be disposed near the opening portion 75. With this configuration, the air that moves through the exhaust duct 71 toward the opening portion 75 passes the vicinity of the control board 96. With this configuration, in addition to the restriction of the temperature rise of the toner container 3K, cooling of the control board 96 is realized.

In addition, in the above-described embodiment, the intermediate transfer unit 5 is provided, and after an intermediate transfer of toner images from the photoconductor drums 41 onto the intermediate transfer belt 5A, a secondary transfer of a toner image onto a sheet member is performed. However, the present disclosure is not limited to this configuration. The present disclosure is applicable to a configuration where the intermediate transfer unit 5 is not provided, and the toner images are directly transferred from the photoconductor drums 41 onto a sheet member. In this case, the primary transfer roller 45 is a specific example of the transfer portion of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

at least one developing portion each including a toner storing portion storing toner, and configured to perform a developing process by using the toner of the toner storing portion;

a transfer portion configured to transfer a toner image formed in the developing process, onto a sheet member;

a fixing portion configured to fix, by heating, the toner image transferred onto the sheet member, to the sheet member;

a first duct portion communicated with the toner storing portion in such a way as to form a flow-in passage through which air having flowed in from an inside of the toner storing portion passes;

a fan configured to suck the air from the flow-in passage of the first duct portion and discharge the air to an outside of the first duct portion;

a filter portion disposed in the first duct portion and configured to collect flying toner included in the air that passes through the flow-in passage;

a second duct portion extending from an air discharge port of the fan along the fixing portion in a vicinity of the fixing portion in such a way as to form a discharge passage through which the air discharged from the air discharge port passes; and an opening portion formed at an end of the second duct portion in an extension direction thereof in such a way as to allow an inside of the second duct portion to be communicated with an outside of an apparatus main body.

2. The image forming apparatus according to claim 1 further comprising at least one toner container disposed above the transfer portion and adjacent to the fixing portion, and configured to supply toner to the toner storing portion, wherein the second duct portion is disposed between the toner container and the fixing portion.

3. The image forming apparatus according to claim 2 further comprising:

at least one photoconductor drum configured to rotate and carry a toner image formed in the developing process; and an intermediate transfer belt which is rotatable and disposed above the photoconductor drum and onto which the toner image carried by the photoconductor drum is transferred, wherein the transfer portion transfers the toner image transferred onto the intermediate transfer belt, onto the sheet member, the toner container is disposed above the intermediate transfer belt, and the second duct portion is disposed, above the intermediate transfer belt, between the toner container and the fixing portion.

4. The image forming apparatus according to claim 3, wherein the intermediate transfer belt extends approximately in a horizontal direction, the at least one photoconductor drum is a plurality of photoconductor drums disposed along an extension direction of the intermediate transfer belt, the at least one developing portion is a plurality of developing portions disposed respectively in correspondence with the plurality of photoconductor drums, the at least one toner container is a plurality of toner containers disposed along the extension direction of the intermediate transfer belt, the first duct portion includes a plurality of communication port portions configured to guide air from insides of the toner storing portions of the plurality of developing portions to an inside of the first duct portion, and the second duct portion is disposed between the fixing portion and a toner container which is, among the plurality of toner containers, closest to the fixing portion.

5. The image forming apparatus according to claim 1, wherein the flow-in passage includes a first passage and a second passage, the first passage being communicated with the inside of the toner storing portion, the second passage being disposed above the first passage and communicated with an air sucking port of the fan, and the filter portion includes a first filter and a second filter, the first filter being disposed between the first passage and the second passage, the second filter being disposed between the second passage and the air sucking port.

6. The image forming apparatus according to claim 1 further comprising a discharged sheet holding portion disposed above the second duct portion and configured to hold sheet members that have passed through the fixing portion and have been discharged to outside, wherein the discharged sheet holding portion includes a communication hole which is communicated with the inside of the second duct portion.

7. The image forming apparatus according to claim 1, wherein a control board is disposed in a vicinity of the opening portion inside the apparatus main body, the control board configured to control an operation of the image forming apparatus.

8. A toner collecting case comprising:

a communication port portion communicated with and connected to a toner storing portion storing toner such that air can flow in from the toner storing portion;

an exhaust port portion configured to discharge inner air to outside;

a first passage through which air having flowed in from the toner storing portion passes;

a second passage disposed above the first passage and configured to guide, to the exhaust port portion, air having flowed in from the first passage;

a first filter disposed between the first passage and the second passage in such a way as to collect flying toner included in the air that has flowed into the first passage; and a second filter disposed between the second passage and the exhaust port portion in such a way as to collect flying toner included in the air that has flowed into the second passage.

* * * * *